United States Patent [19]

Vondruska

[11] Patent Number: 4,892,496

[45] Date of Patent: Jan. 9, 1990

[54] WEB GLOVE

[76] Inventor: Charles Vondruska, Box 1662, Newport Beach, Calif. 92663

[21] Appl. No.: 234,545

[22] Filed: Aug. 22, 1988

[51] Int. Cl.[4] ..... A63B 31/02

[52] U.S. Cl. ..... 441/57; 441/55

[58] Field of Search ..... 441/55, 56–58, 441/71; 272/116, 119

[56] References Cited

U.S. PATENT DOCUMENTS

| | | | |
|---|---|---|---|
| 869,190 | 10/1907 | Matter | 441/58 |
| 1,066,697 | 7/1913 | Baker | 441/57 |
| 1,299,007 | 4/1919 | Naruszewicz | 441/58 |
| 1,371,708 | 3/1921 | Schreiner | 441/57 |
| 1,625,730 | 4/1927 | Lake | 441/57 |
| 2,726,410 | 12/1955 | Adamopoulos | 441/57 |
| 3,056,979 | 10/1962 | Holladay | 441/66 |
| 3,257,673 | 6/1966 | Rademacher | 441/57 |
| 4,058,863 | 11/1977 | Ferdico | 441/57 |
| 4,746,313 | 5/1988 | Bray et al. | 441/57 |

*Primary Examiner*—Sherman D. Basinger
*Assistant Examiner*—E. L. Swinehart

[57] ABSTRACT

A web glove for swimmers, surfers and divers with an optional removable brace.

1 Claim, 1 Drawing Sheet

WEB GLOVE

BACKGROUND

1. Field of Invention

This invention is a web glove which increases the effective area of the paddling hands of swimmers, surfers and divers, thus enabling a more effective propelling motion in water.

2. Description of Prior Art

Presently swimmers use wooden or plastic paddles attached to their hands in order to increase the resistance of the moving arm in water resulting in greater speed and increased exercise of the arm, shoulder and torso muscles. These paddles interfere with the smooth insertion of the hand into water and they cannot be used by surfers and divers who need to grasp their surfboards and tools during their other activities.

SUMMARY OF THE INVENTION

Gloves with webs between the thumb and the fingers provide an increased resistance area for a more effective use of the arms for propelling in water while not preventing the free articulation of the thumb and the fingers when needed to grasp objects or to hold together the thumb and the fingers in order to achieve a smooth insertion of the hand into water.

A removable brace may be added for use during extended periods of paddling.

OBJECTS AND ADVANTAGES OF THE INVENTION

Accordingly, I claim the following objects and advantages of the invention:

The invention comprises a glove with elastic or flexible webs integrally molded between the thumb and the fingers. As an additional feature a removable brace, inserted into sockets either integrally molded or glued onto the palm side of the glove and stretching between the thumb and the little finger, may be added.

The flexible webs between the thumb and the fingers allow for holding the thumb and the fingers together in order to permit the grasping of surfboards and tools and in addition to allow a smooth insertion of the hand into water.

The removable brace reduces the effort necessary to keep the webs stretched.

DESCRIPTION OF THE INVENTION

The invention comprises a glove with hollow elongate finger and thumb portions and elastic or flexible webs between the finger and thumb portions. As an additional feature a removable brace stretching between the thumb and the little finger of the web glove may be added.

Figure 1:
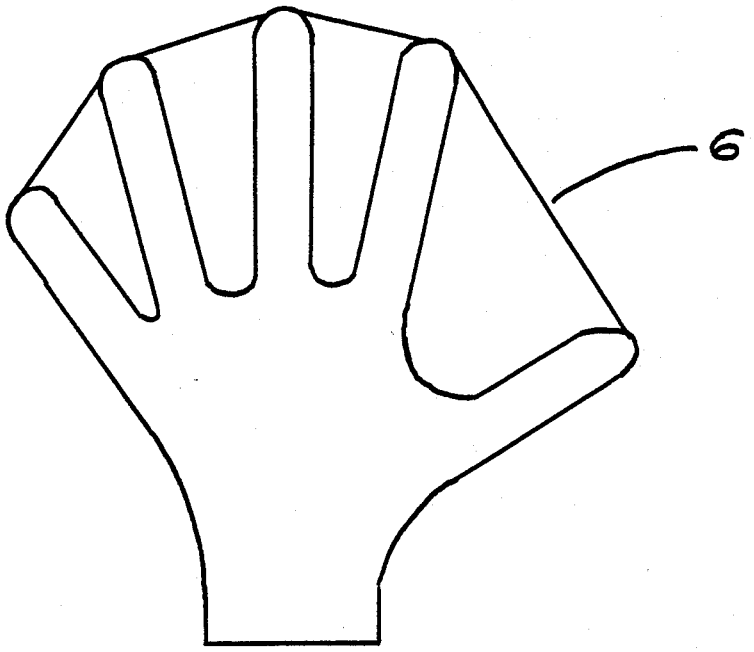
FIG. 1 shows the palm face of a right hand web glove with the flexible webs fully stretched. A left hand web glove would be an opposite view.

FIG. 1 shows the palm face of the right hand web glove with the thumb and the fingers fully apart and the webs stretched.

Figure 2:
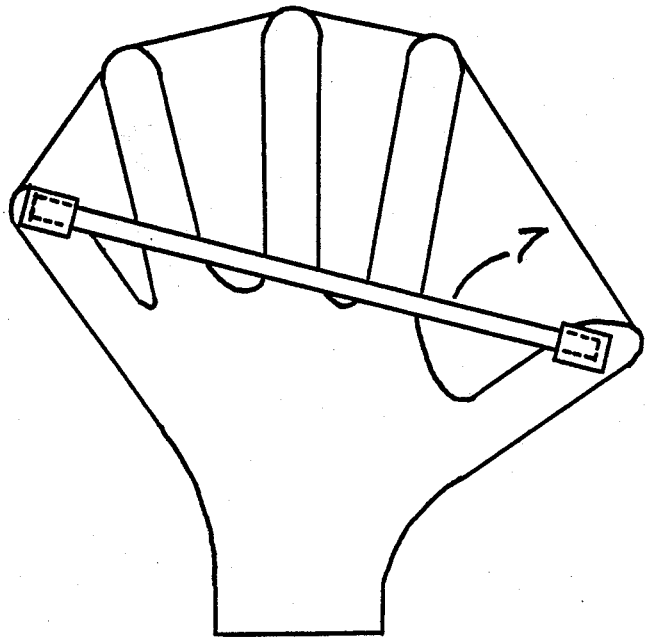
FIG. 2 shows the web glove with a removable brace between the thumb and the little finger.

FIG. 2 shows the palm face of the right hand web glove with a removable brace between the thumb and the little finger.

Numeral 6 shows a typical web.

Numeral 7 shows the removable brace.

OPERATION OF THE INVENTION

The web gloves may be used by swimmers, surfers and divers. With the thumb and the fingers held together, the web glove allows the grasping of objects just as with an unaided hand. It also facilitates the smooth insertion of the hand into water. With the thumb and the fingers held apart, the web glove's increased resistance area will enhance a more effective propelling motion in water. In addition, the increased resistance will enhance the exercise of the arm, shoulder and torso muscles of the users.

For extended periods of paddling and in order to ease the strain on the stretched thumb and fingers, a removable brace may be used between the thumb and the little finger (or any other finger) of the web glove.

CONCLUSION AND ALTERNATE FORMS OF THE INVENTION

The invention of the web glove will enhance the propelling motion of swimmers, surfers and divers in water.

The web glove represents a typical arrangement of the invention. Numerous methods of attaching the web glove to the hand, such as a snug fit, elastic bands or zipper at the wrist may be used.

For use in warm water only a partial glove, netting or finger rings may be used.

I claim:

1. A swimming glove for placement over the hand of a swimmer, comprising hollow elongate finger and thumb portions, said portions being joined to one another by integral flexible web portions, and an elongated removable brace for maintaining said swimming glove in an outstretched configuration, said elongated removable brace extending from an outer end of an elongated finger portion intended to accommodate the little finger of a swimmer, to an outer end of the elongated thumb portion.

* * * * *